US009316003B2

(12) United States Patent
Caimi

(10) Patent No.: US 9,316,003 B2
(45) Date of Patent: Apr. 19, 2016

(54) SYSTEM FOR ARRANGING A PLURALITY OF SOUND-ABSORBING AND/OR SOUND-REFLECTING PANELS OR THE LIKE

(71) Applicant: ELEDA S.r.l., Milan (IT)

(72) Inventor: Renato Caimi, Milan (IT)

(73) Assignee: ELEDA S.r.l., Milan (IT)

( * ) Notice: Subject to any disclaimer, the term of this patent is extended or adjusted under 35 U.S.C. 154(b) by 0 days.

(21) Appl. No.: 14/661,694

(22) Filed: Mar. 18, 2015

(65) Prior Publication Data

US 2015/0267417 A1 Sep. 24, 2015

(30) Foreign Application Priority Data

Mar. 21, 2014 (IT) ..... MI2014U0112

(51) Int. Cl.

| | |
|---|---|
| ***E04B 1/82*** | (2006.01) |
| ***E04B 1/84*** | (2006.01) |
| ***E04F 13/08*** | (2006.01) |
| ***E04B 1/99*** | (2006.01) |
| *E04B 1/86* | (2006.01) |

(52) U.S. Cl.

CPC ..... *E04F 13/0867* (2013.01); *E04B 1/994* (2013.01); *E04B 1/86* (2013.01); *E04B 2001/8263* (2013.01); *E04B 2001/8452* (2013.01)

(58) Field of Classification Search

CPC ..... E04B 2001/8263; E04B 2001/8452; E04F 13/0801; E04F 13/0862; E04F 13/0867; E04F 13/26

See application file for complete search history.

(56) References Cited

U.S. PATENT DOCUMENTS 3,534,829 A * 10/1970 Schneider ..... 181/290
4,258,511 A * 3/1981 Strain ..... 52/79.1

* cited by examiner

*Primary Examiner* — Andrew J Triggs
(74) *Attorney, Agent, or Firm* — Patti & Malvone Law Group, LLC

(57) ABSTRACT

A system for arranging a plurality of sound-absorbing panels or the like is described. The system includes a first and a second guide and a first and a second panel, and each of said guides further includes a longitudinal axis, and a first longitudinal groove and a second longitudinal groove substantially parallel to said longitudinal axis, such that the first panel is retained in the first groove of the first and second guides and the second panel is retained in the second groove of the first and second guides and further such that at least one of the panels is displaceable in a guided manner inside the respective longitudinal groove.

12 Claims, 11 Drawing Sheets

SYSTEM FOR ARRANGING A PLURALITY OF SOUND-ABSORBING AND/OR SOUND-REFLECTING PANELS OR THE LIKE

FIELD OF INVENTION

The present invention relates to a system for arranging a plurality of panels for creating panel compositions. The panels may be sound-absorbing, sound-reflecting or the like.

BACKGROUND

It is known that, when a sound wave emitted in a closed room encounters a surface, part of its energy passes through the surface, part is absorbed by the impact with the surface and part is reflected into the room.

If, in a room, the reflective surface area is high, the room may be acoustically very disturbed since the sound waves produced inside it are amplified with an effect similar to that of an echo.

In order to improve the acoustics of a room, without structural modifications, it is known to provide in the room one or more sound-absorbing panels for absorbing a large amount of the energy.

The acoustic correction measures involve lining the internal surfaces of the rooms with sound-absorbing materials; they must have suitable characteristics not only acoustically, but also aesthetically speaking, since they are required to blend in with the interior design and furnishings.

Sound-absorbing materials have the property that they absorb at least a part of the acoustic energy and reduce the amount of reflected energy.

The known sound-absorbing materials, to be applied for example to a wall, have a structure composed of a layer of foam material (for example foam rubber) lined with a sheet and kept rigid by a perimetral frame made of metal (for example aluminium), plastic or wood. The sheet is typically wrapped around the perimetral frame so as not to show, at least on one visible side, stitching or other joints. However, when a sound-absorbing panel must have two visible sides, it is more difficult to mask a joint in the sheet, in a zone where one edge of the sheet overlaps the other edge of the sheet.

In other known panels, the padding layer is combined with a rigid surface (for example made of metal, plastic or wood) which increases the rigidity thereof. The rigid surface may be positioned on one side of the padding or inside the padding itself, creating a sandwich structure.

A first drawback of the sound-absorbing panels made according to the prior art consists in the presence of the frame or support surface. Said panels may in fact have a considerable weight and therefore be difficult to handle, install and support; moreover often the frame or the support surface constitute the most costly item of the panel.

Another drawback, as already mentioned, is that the sound-absorbing panels must have not only good sound-absorbing properties, but also satisfactory aesthetic characteristics since they must blend in with the interior design and the furnishings. The frame and the joints between two sheet edges used to cover the panel undoubtedly constitute unattractive features which do not blend in with the surroundings.

The problem which arises is that of providing a system for arranging a plurality of panels, for example a plurality of sound-absorbing panels, in order to create compositions which are suitable for the space available.

SUMMARY

According to the Applicant, the problem may be solved with a system comprising at least one pair of guides, a first panel and a second panel. Each of the guides comprises at least two guide grooves which extend longitudinally parallel to the longitudinal axis of the guide. One of the grooves acts as a guide for an edge of the first panel and the other of the grooves acts as a guide for an edge of the second panel so that the first and second panels may slide parallel to each other.

According to one aspect of the invention, a system for arranging a plurality of sound-absorbing, sound-reflecting or the like is provided. The system comprises a first and a second guide and a first and a second panel, wherein each of said guides comprises a longitudinal axis, a first longitudinal groove and a second longitudinal groove substantially parallel to said longitudinal axis, wherein the first panel is retained in the first groove of the first and second guides and the second panel is retained in the second groove of the first and second guides and wherein at least one of the panels is displaceable in a guided manner inside the respective longitudinal groove.

At least one of said guides also comprises a third longitudinal groove and a fourth longitudinal groove.

At least one of said guides is at least partially made of wood, a plastic or thermoplastic material or a metallic material, for example chosen from the group comprising steel, stainless steel, aluminium and aluminium alloy.

For each guide, at least one fixing member may be provided.

The fixing member may comprise a wall mount with a pin and a screw configured to engage inside a threaded hole of said pin and a hole in the guide.

The wall mount preferably also comprises a plate with holes for fixing the plate to a wall by means of screws or some other known system.

The threaded through-hole has an axis substantially perpendicular to the longitudinal axis of the pin.

Preferably, at least one guide comprises a first hole for receiving the pin and a second hole for receiving the screw which engages inside the threaded through-hole, wherein the first and second holes have axes which are perpendicular to each other, wherein the first axis is substantially horizontal and the second axis is substantially vertical, in the direction of the depth of the grooves.

Preferably, the first hole has a diameter substantially greater than the diameter of the pin.

At least one closing element may be provided for at least one of the guides.

The system may be fixed to one or more vertical uprights positioned on a wall, at a certain distance from a wall or substantially in the centre of a room or other space.

DETAILED DESCRIPTION

In the present description, for the sake of simplicity, the term "sound-absorbing panel" is mainly used, but it is understood that this wording embraces other panels which affect the acoustics of a room, for example sound-reflecting panels.

Figure 1:
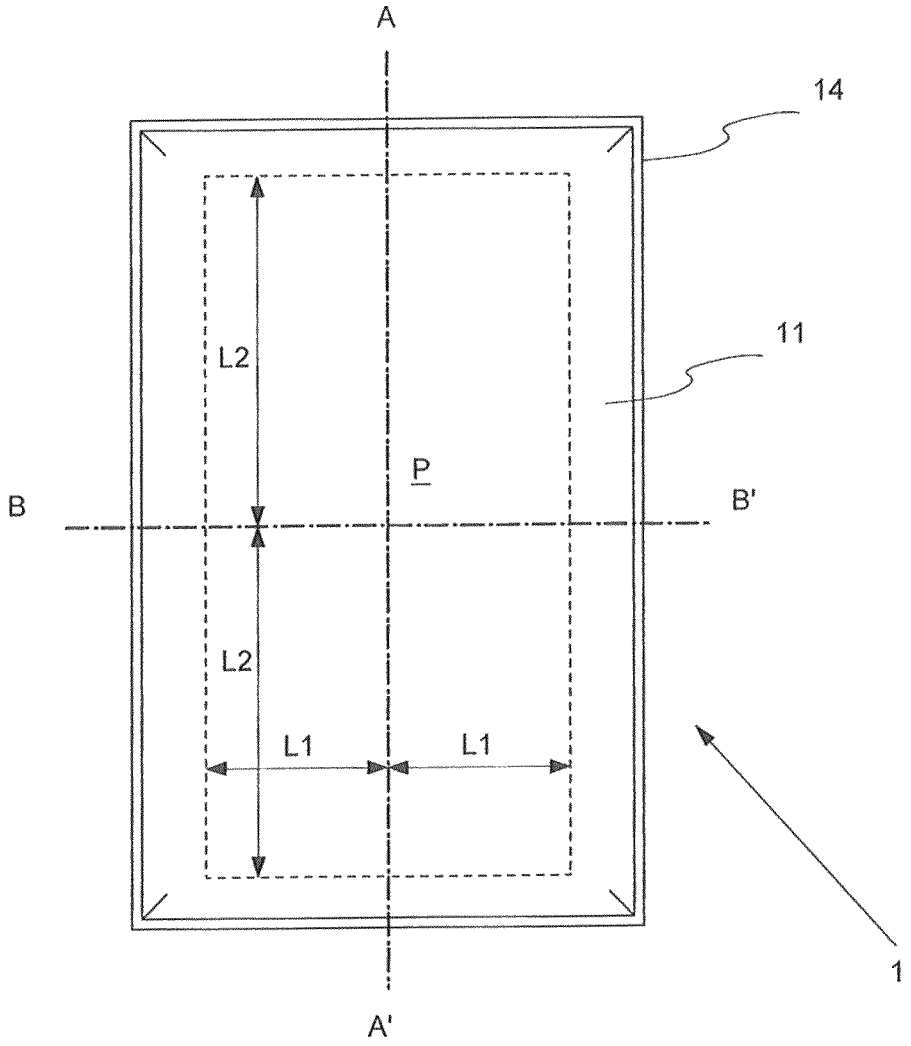
FIG. 1 is a schematic front view of a sound-absorbing panel suitable for use with the present invention.
Figure 2:
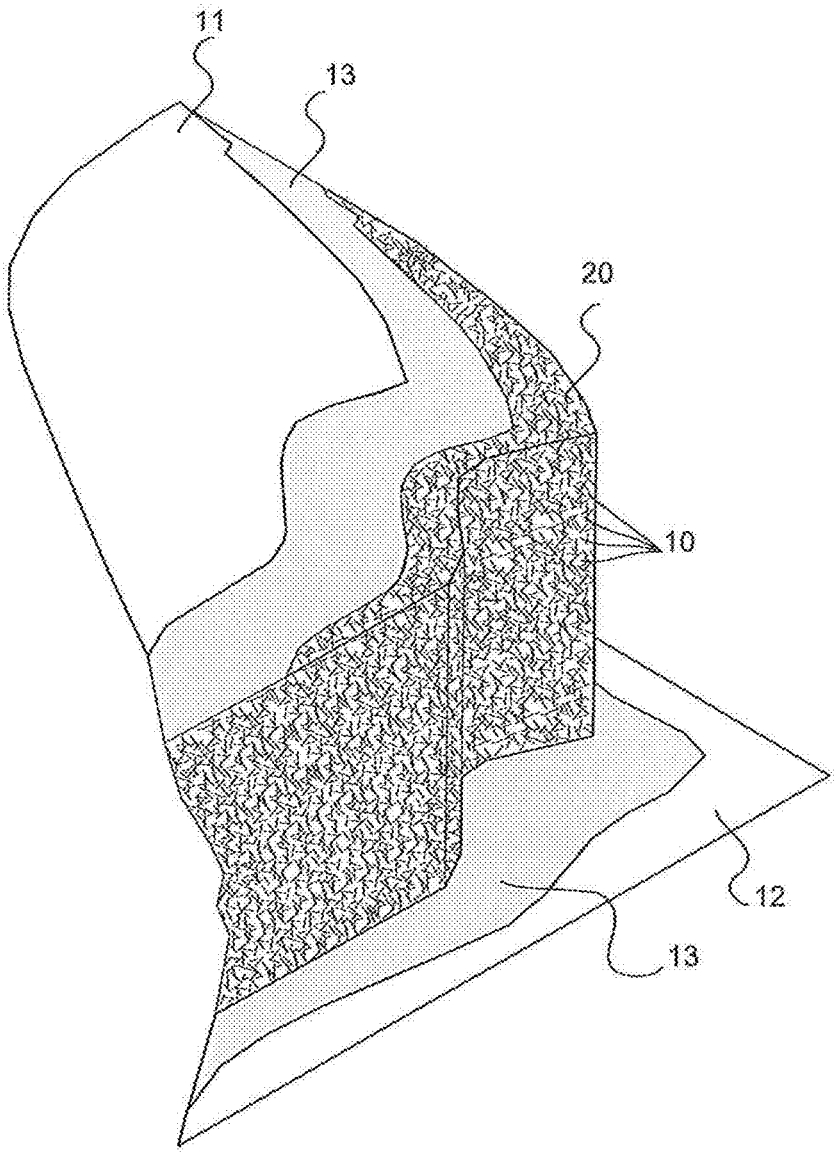
FIG. 2 shows the various layers of the panel according to FIG. 1.
Figure 3:
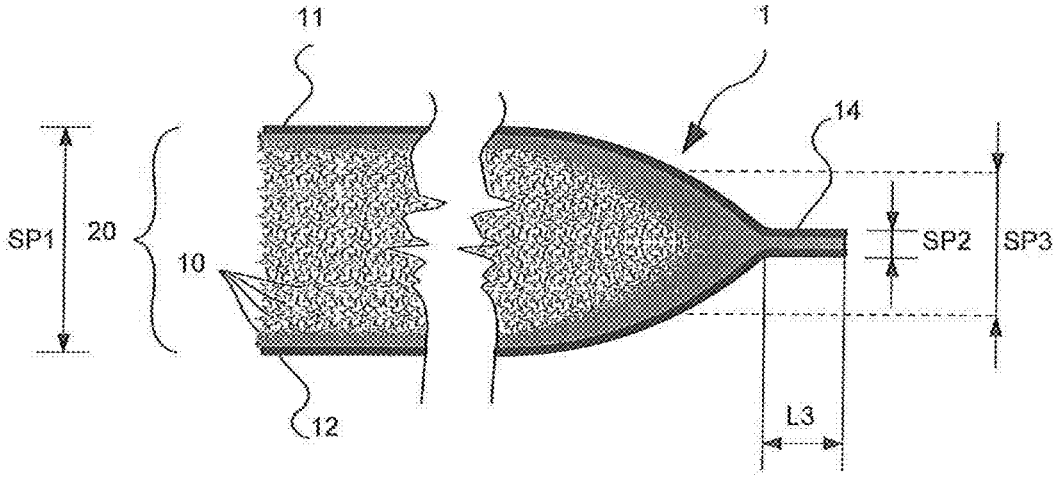
FIG. 3 is a schematic cross-sectional view of a part of the panel according to FIG. 1.

With reference to FIGS. 1, 2 and 3, these show a sound-absorbing panel 1 comprising a padding layer 20 which is preferably shaped. Said panel preferably comprises heat-bonded synthetic fibres 10 and a first and second layer of fabric facing each other on opposite sides of the padding layer 20. The padding layer 20 is shaped so as to have an edge 14 with a smaller thickness than the thickness of the padding layer in a central position of the panel 1. The edge has an edge width indicated by L3 in FIG. 3.

The panel may have a rectangular shape (as in FIG. 1) or any other shape such as a square, irregular quadrilateral, trapezoidal, circular, oval, elliptical, triangular or other shape.

In one embodiment, the heat-bonded synthetic fibres 10 comprise polyester fibres.

Preferably, the fibres are non-toxic and non-irritants. Furthermore they may be fully recycled.

The sound-absorbing panel 1 preferably comprises a first fabric layer 11 facing a first side of the padding layer 20. The sound-absorbing panel 1 also comprises, preferably, a second fabric layer 12 facing a second opposite side of the padding layer 20 (FIG. 3).

Preferably, the fabric layers 11, 12 are also made of polyester.

In one embodiment, the fabric is of the Trevira CS flame-retarding type.

The panel 1 may comprise preferably an adhesive layer 13 arranged between the padding layer 20 and each of the fabric layers 11 and 12.

In particular, the adhesive layer 13 may advantageously comprise a layer of glue, preferably applied by means of spreading.

The panel 1, in a central position P thereof (FIG. 1), has a first thickness SP1 (FIG. 3) preferably of between about 2 cm and about 7 cm. In one embodiment, the first thickness SP1 is about 3.7 cm.

For the purposes of the present description and the accompanying claims, the term "central position P" is understood as meaning a position inside a central area of the panel. In turn, the term "central area" is understood as meaning an area which is sufficiently distant from the perimeter of the panel and from the transition contour. For example, for a rectangular shaped panel with a first axis parallel to the long side and a second axis parallel to the short side, the central area is a substantially rectangular area symmetrical relative to the first and second axes. The central area may have a width equal to 2×L1, where L1 is about 30% of the width of the panel, and a length equal to 2×L2, where L2 is about 30-40% of the height of the panel. FIG. 1 shows in the form of a broken line, by way of example, a central area for the panel 1. In the case of a square shaped panel, the central area may have a square area centred on the centre of the panel having a side with a length equal to about 50% of the side of the panel. In the case of a circular shaped panel, the central area may be a central area centred on the centre of the panel and having a diameter equal to about 50% of the panel diameter. In the central area there may be depressions used for fastening purposes, but these local depressions with a small thickness must not be considered for the purposes of an evaluation of the thickness of the panel in the central area.

Advantageously, the panel 1 may be shaped so as to have an edge 14 with a second thickness SP2, smaller than the first thickness SP1 (FIG. 3). The edge 14 has a width L3 which may be for example equal to about 0.5-2 cm.

The second thickness SP2 in the region of the edge 14 may be between 5% and about 30% of the first thickness SP1.

The edge 14 may be formed along at least part of the perimeter of the panel 1 or, alternatively, along the entire perimeter of the panel 1.

The panel 1 may have a transition thickness SP3 (FIG. 3) which is variable depending on the distance between the edge 14 and the central position P.

In particular, the transition thickness SP3 increases from the value of the second thickness SP2 to the value of the first thickness SP1 with a substantially logarithmic progression as the distance from the edge 14 increases.

The panel 1 has density values which vary from the central position P as far as the edge 14.

Moreover, preferably, the padding layer 20, in at least one portion of the panel (for example the central area P), has a variable density, which is greater in the region of its external layer and smaller in the region of its inner layer.

Advantageously, according to the invention, the structure created does not require any support frame; in fact the edge 14 acts as a frame.

Moreover, the panel does not require any joint between sheet edges, since no covering sheet is envisaged; the covering, in fact, in one embodiment, consists of the fabric layers 11 and 12 which form a single body with the padding layer 20. The aesthetic characteristics, therefore, are particularly attractive and may be blended in (also in terms of colours or shapes) with the characteristics of the surroundings.

The low weight of the panel 1 facilitates the design of all the support means necessary for hanging or joining the panel.

Preferably, the padding layer 20 and the fabric layers 11, 12 are made of fireproof material.

Preferably, the padding layer 20 and the fabric layers 11, 12 are treated with antibacterial material.

In short, the panel achieves a number of advantages: it does not require any support frame because the edge acts as a frame; it does not require any joint between sheet edges since (at least in one embodiment) no covering sheet is envisaged; the covering, in fact, consists of the fabric layers which forms a single body with the padding layer, and the aesthetic characteristics are particularly attractive and may be blended in with the characteristics of the surroundings.

The edge also acts, at least partly, as a sound-absorbing material and prevents the reflection of sound waves.

The low weight of the panel facilitates the design of all the support means necessary for hanging or joining the panel.

It is fully recyclable since it is made entirely of polyester.

Figure 4:
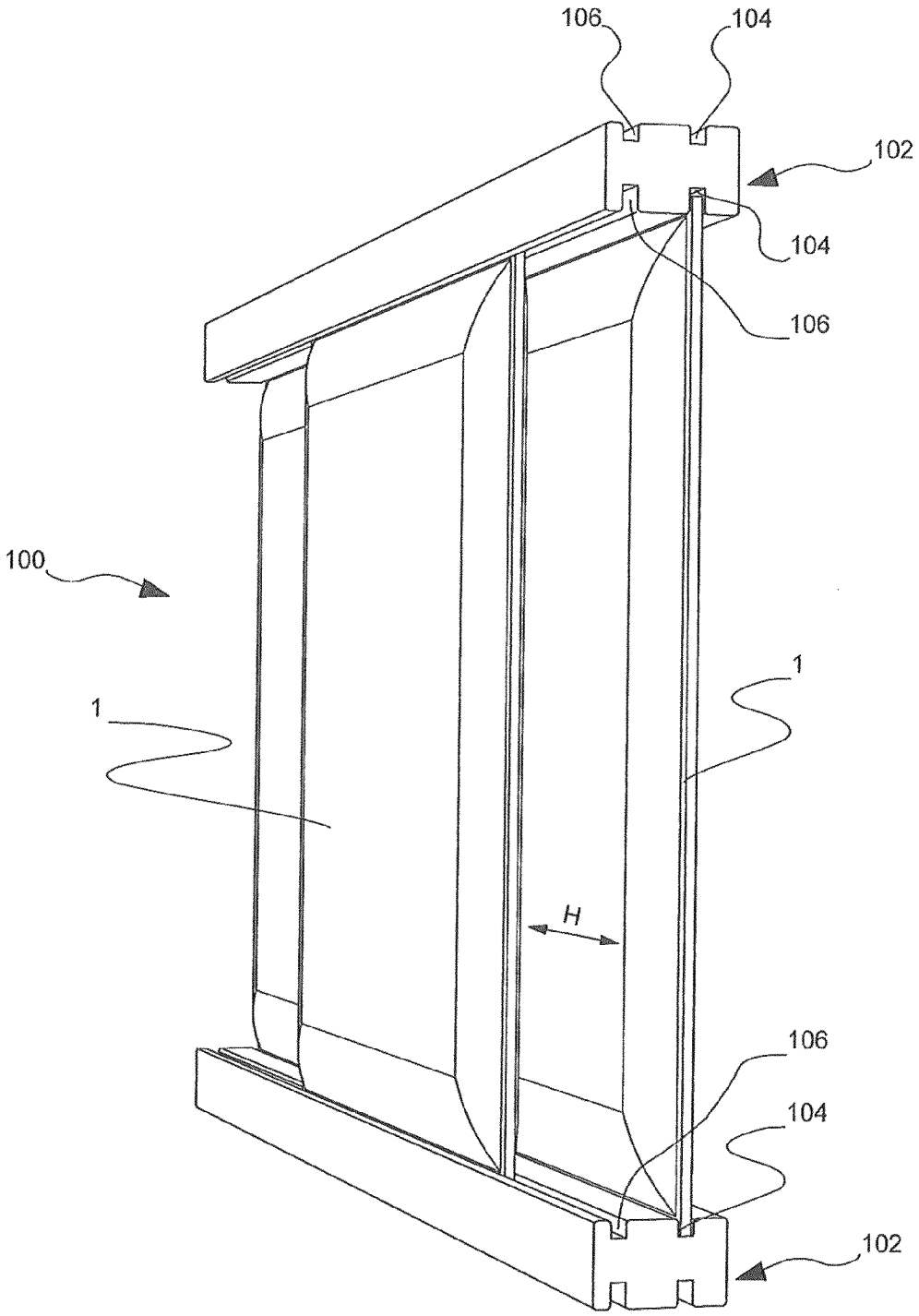
FIG. 4 is an axonometric view of an embodiment of the system according to the invention without end closing elements.

FIG. 4 shows a system 100 for arranging a plurality of panels 1, typically sound-absorbing panels 1, preferably of the aforementioned type. The system comprises a first guide 102, a second guide 102 and at least two panels 1. Depending on the dimensions of the panels and/or the dimensions to be used for assembly of the system and/or the technical sound-absorbing and/or aesthetic requirements, several guides 102 and/or several panels 1 may be provided.

Figure 6:
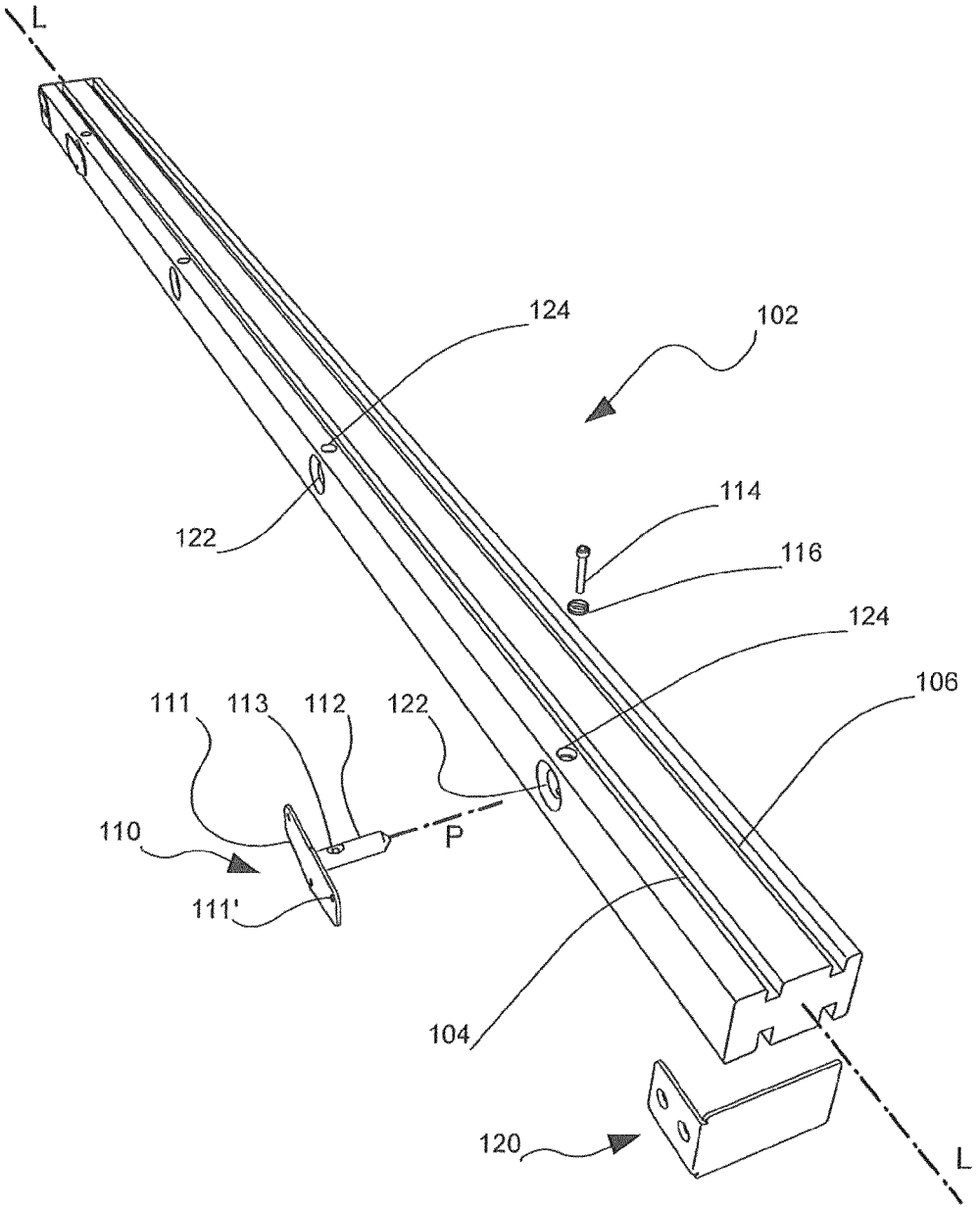
FIG. 6 is a partially exploded view of a guide of the system according to FIG. 5.

According to one embodiment, each guide 102 is formed by an elongated body with a straight longitudinal axis L (FIG. 6). Each guide 102 comprises a first guide groove (internal groove) 104 and a second guide groove (external groove) 106.

The guide grooves 104, 106 extend parallel to each other and parallel to the longitudinal axis L of the guide 102.

As shown in FIG. 4 (and also in the other figures), the guides 102 may also have a third (internal) guide groove 104 and a fourth (external) guide groove 106.

Preferably, the guides 102 are mounted horizontal and parallel at a certain distance from each other. The distance between the guides is such that the distance between the bottom of the first groove 104 (or second groove 106) of the lower guide and the bottom of the first groove 104 (or second groove 106) of the upper guide is substantially the same as one of the dimensions of the panel. Preferably the distance between the guides 102 is such as to leave a certain play in order to allow sliding of the panels 1 in the direction of the arrow H without their being able to come out of the guide grooves 104, 106.

Each guide groove is configured to receive an edge 14 of the panel. In particular, the first groove 104 is configured to receive the bottom edge and the top edge of the first panel and the second groove is configured to receive the bottom edge and the top edge of the second panel.

Typically the guides 102 have a length greater than the width of the panel 1 and therefore the panels may slide, guided inside the guide grooves 104, 106, and be positioned in an infinite number of positions and if necessary locked in place using a system (not shown). The (interaxial) distance between the grooves 104, 106 of a same guide is such as to allow sliding of the panels 1 without one hindering sliding of the other one. This can be seen, for example, in the cross-sections of FIGS. 7*a*, 7*b* and 7*c*.

Figure 5:
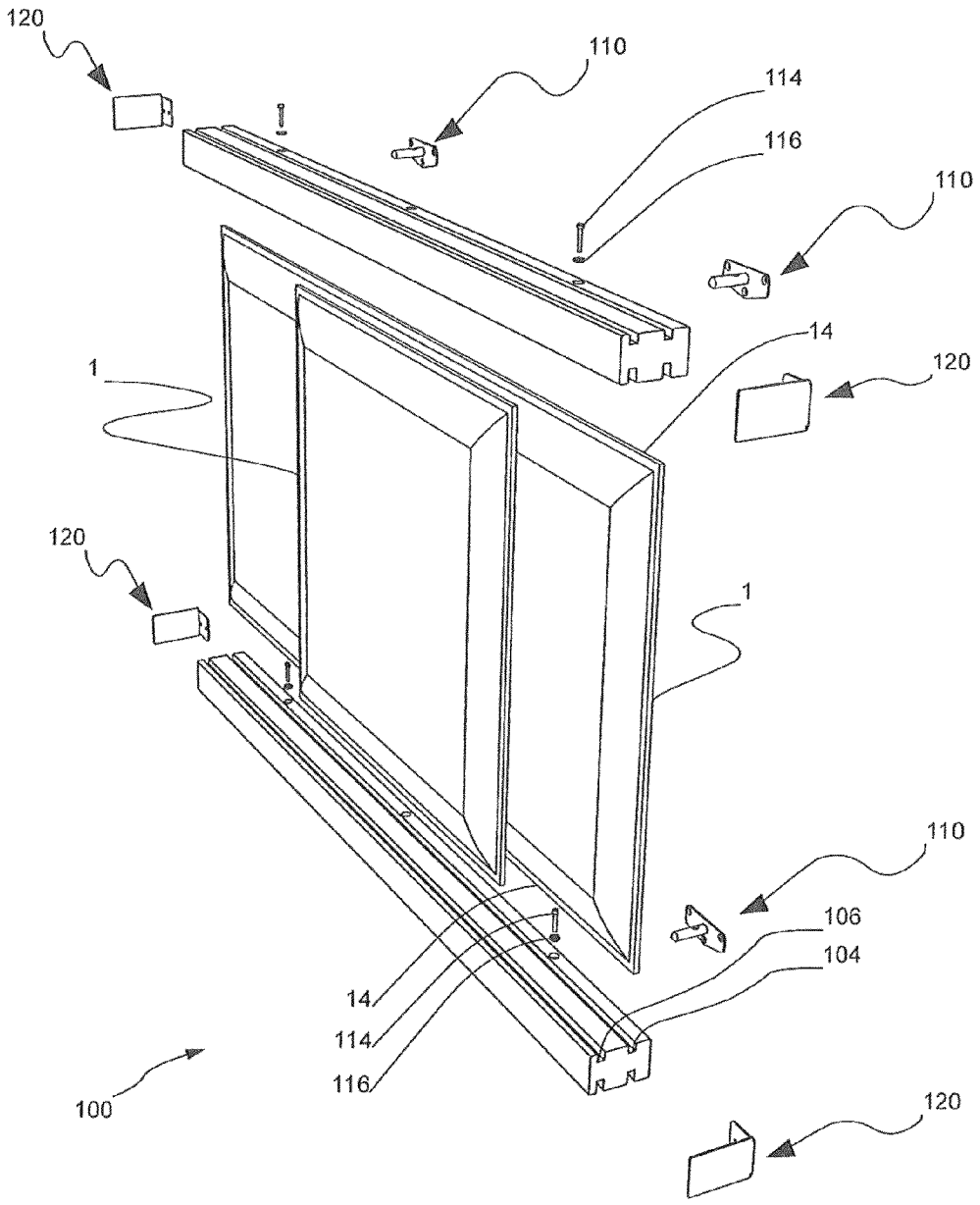
FIG. 5 is an exploded view of the system according to FIG. 4 with end closing elements.

FIG. 5 is an exploded view of the system according to FIG. 4 and shows an embodiment of fixing members 110, 114, 116 for fixing the guides 102 to a wall. FIG. 5 also shows end closing elements 120 for the guides.

Each fixing member comprises a wall mount 110 with a pin 112 and a screw 114 (with washer 116) configured to engage inside a threaded hole 113 of the pin 112 and a hole 124 in the guide. The screw 114 may be, for example, a screw with a hexagonal socket head.

Preferably, the washer 116 has an oval shape so as to allow the adjustment of the screw and compensate for the play. This characteristic feature can be seen in the cross-section shown in FIG. 8.

The wall mount 110 also comprises a plate 111 with holes 111' for fixing the plate 111 to a wall by means of screws (or screw and plugs or another known system). The pin 112 has a longitudinal axis P. The threaded through-hole 113 has an axis substantially perpendicular to the longitudinal axis P of the pin 112.

The guide 102 comprises a first hole 122 (preferably flared) for receiving the pin 112, and a second hole 124 for receiving the screw 114 which engages inside the threaded through-hole 113. The first and second holes 122, 124 in the guide 102 have axes which are perpendicular to each other. The first axis is substantially horizontal. The second axis is substantially vertical, in the direction of the depth of the grooves 104, 106. Preferably, the second hole 124 is visible only from above and is formed in the top surface of the guide. FIG. 6 shows a guide 102 from above so that the holes 124 may be seen. For each guide several holes 122, 124, preferably spaced at a regular distance from each other, are preferably provided.

Figure 7A:
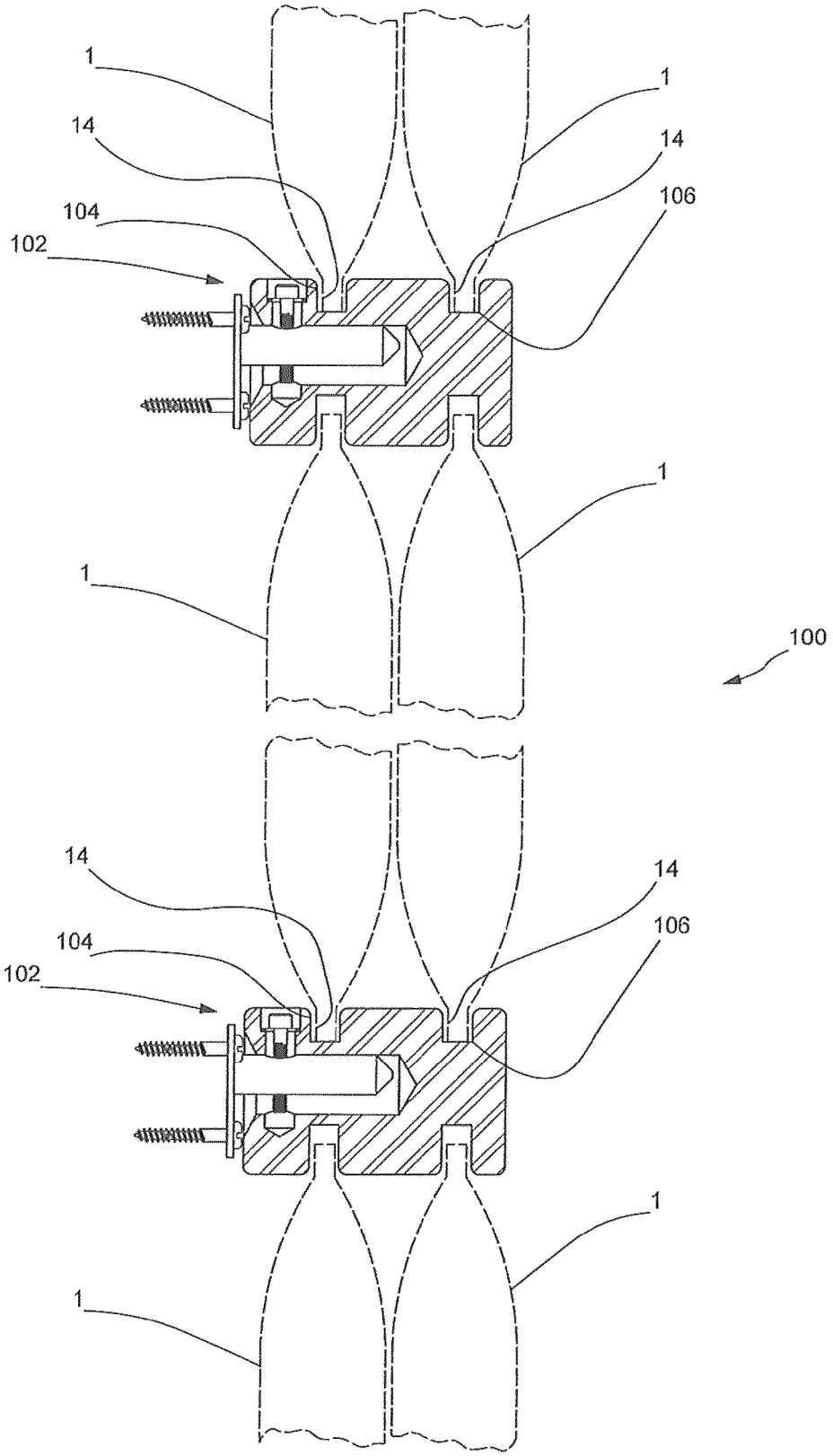
FIG. 7*a* is a cross-sectional view of the system according to FIG. 4 with other rows of panels.
Figure 8:
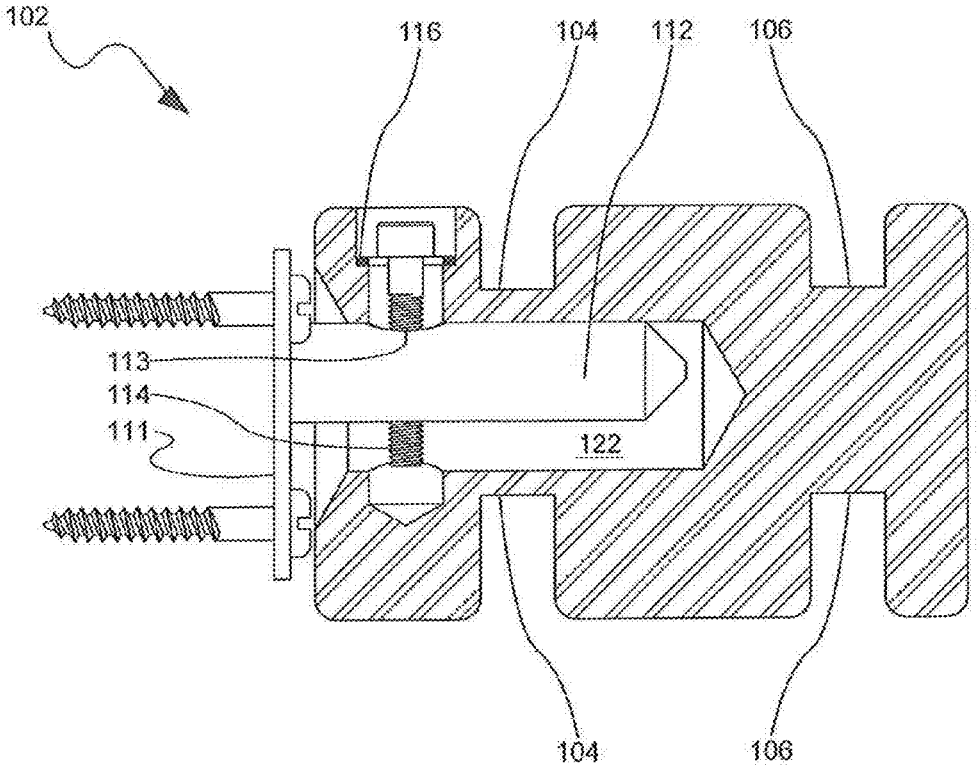
FIG. 8 is an enlarged view of a guide of the system according to the invention.

Preferably, the first hole 122 has a diameter substantially greater than the diameter of the pin 112, as shown in the cross-sections of FIGS. 7*a* and 8. This feature is very advantageous. In fact, on the one hand it allows the correction of any minor misalignments during assembly and on the other hand it also allows removal of the panels 1 without disassembly of the mounts 110 from the walls and without completely removing the guides 102. For example, with reference to FIG. 7*a*, the upper guide may be displaced upwards by slackening the respective screws 114. The displacement allows the top edges of the panels 1 to be extracted from the upper grooves so that the panels may be removed more easily.

In embodiments of the invention end closing elements 120 may be provided for the guides 102. These closing elements may be in the form of L-shaped plates which can be fixed by means of screws to the surface of the guide which remains facing the wall and therefore is not visible when the guide is fixed to the wall. Alternatively it is possible to provide shaped stoppers made of metal, plastic or wood.

As shown in various figures, for example FIGS. 5, 6 and 7*a*, each guide 102 may have four grooves, two upper grooves and two lower grooves. This allows the panels to be arranged, if necessary at least partially overlapped, along several parallel rows (FIG. 7*a*).

Figure 7B:
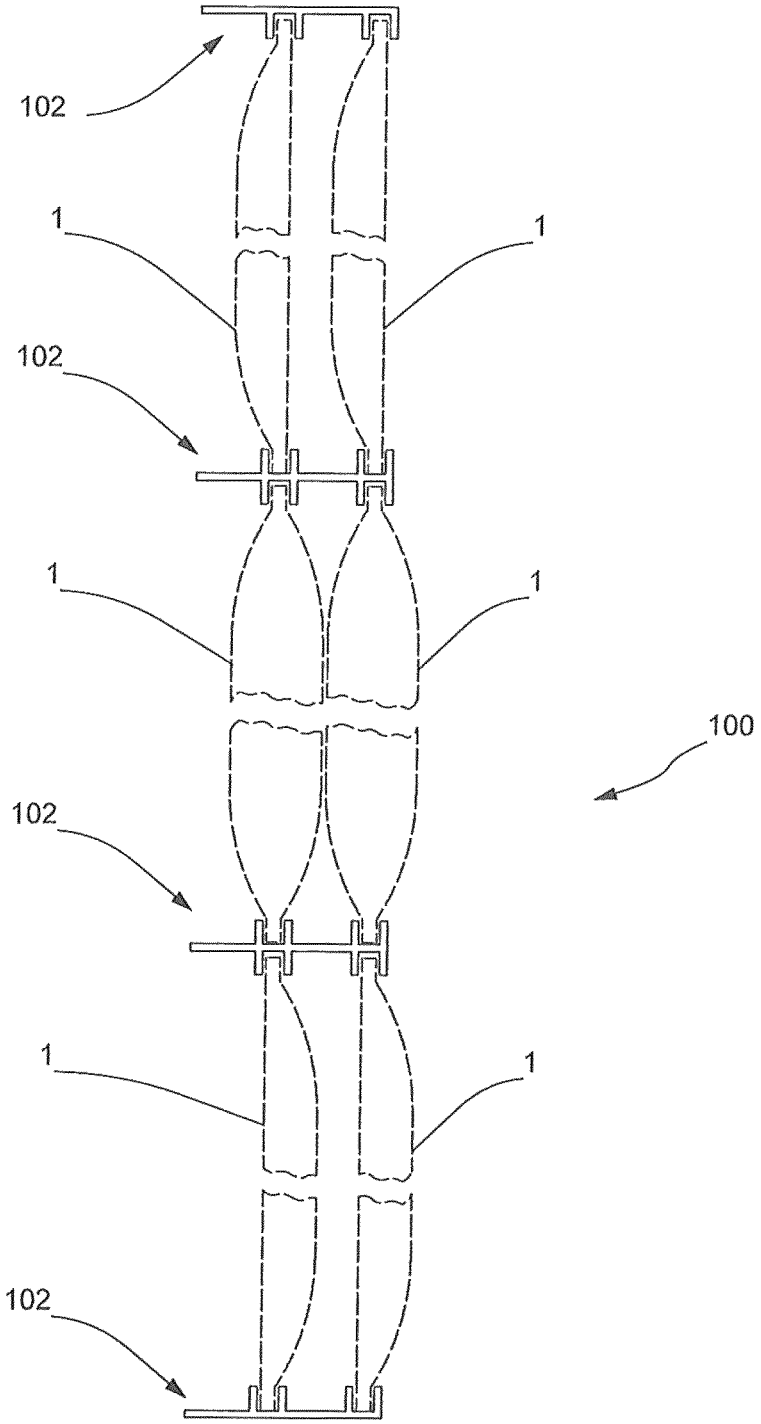
FIGS. 7*b* and 7*c* are schematic cross-sectional views of alternative systems.

FIG. 7*b* shows in schematic form a configuration with three rows of panels. For each row, there are one or more panels displaceable along the internal guide groove 104 (relative to a wall, not shown) and one or more panels displaceable along the external guide groove 106 (relative to the wall).

The guides 102 may have only two guide grooves (such as the upper guide and the lower guide) or four guide grooves (such as the intermediate guides).

The panels may be symmetrical with a curvature on both sides (as in the case of the panels in the central row of FIG. 7*b*) or may have a curvature on only one side (panels of the upper row or lower row in FIG. 7*b*) which in turn may be the visible side or the side facing the wall.

Figure 7C:
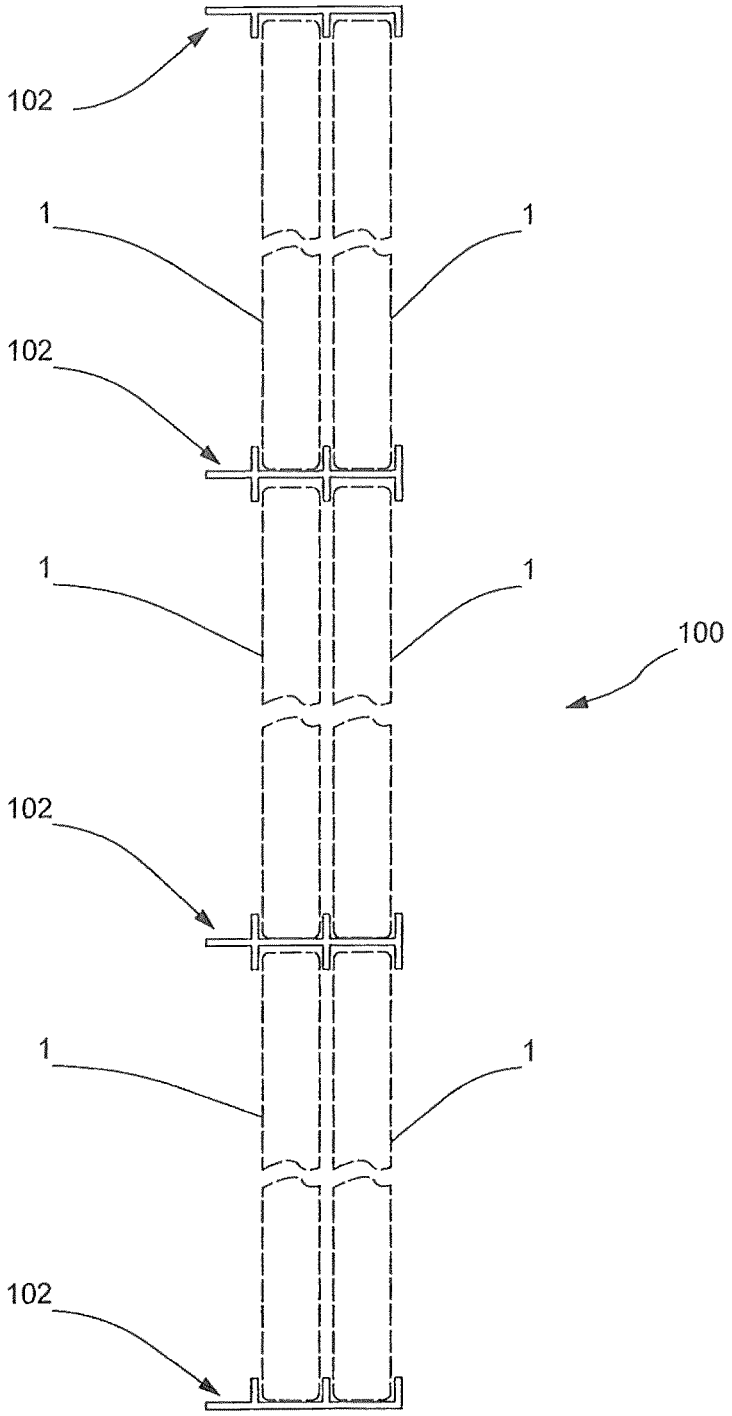

FIG. 7*c* shows a configuration similar to that of FIG. 7*b*, but in this case flat panels without a small-thickness edge have been used.

One composition could comprise panels with different sound-absorbing characteristics or sound-reflecting panels. By displacing the panels with different characteristics relative to each other it is possible to easily adjust the general sound-absorbing performance of the entire composition.

For example, by overlapping one reflective panel with a sound-absorbing panel, the capacity of the composition to absorb sound is partially neutralized and therefore the reverberation time increases. This solution could be effective when used in recording studios or multi-functional rooms which, since they are intended for different uses, require ideal reverberation times for each event (banquet, concert, meeting, conference, etc.).

In other cases it may be decided to insert into the composition sound-absorbing panels with dimensions such that they are arranged over practically the whole surface, thereby increasing the acoustic performance of the composition, while leaving the overall surface area of the composition unchanged.

The guides 102 may be made of any material such as wood, metal (typically steel, stainless steel, aluminium or aluminium alloy) or plastic.

The various figures show two guide grooves for each side. The scope of the invention obviously includes the possibility of having more than two grooves per side, for example three or four grooves, so as to be able to insert several panels and have a greater flexibility in terms of positioning and adjustment.

In addition to a vertical wall, the guides could also be assembled on the ceiling so as to form false ceilings or the like.

In other embodiments, the guides may be hung and/or mounted from vertical uprights which can be positioned on a wall or in the centre of a room in order to create partitions or screens.

In the case of very long walls two or more guides may be aligned. In the case of shorter walls, the guides may be cut to size and the panels may be positioned so as to occupy the entire length of the guides.

As mentioned above, two or more panels, slidable inside the parallel guide grooves, may be installed for each pair of guides. In this way, the panels sliding inside the external guide groove may be arranged also partially overlapping with respect to the internal panels. It is thus possible to create a practically infinite number of combinations of panels, in terms of number of panels, colour, arrangements, measurements, etc.

Figure 9:
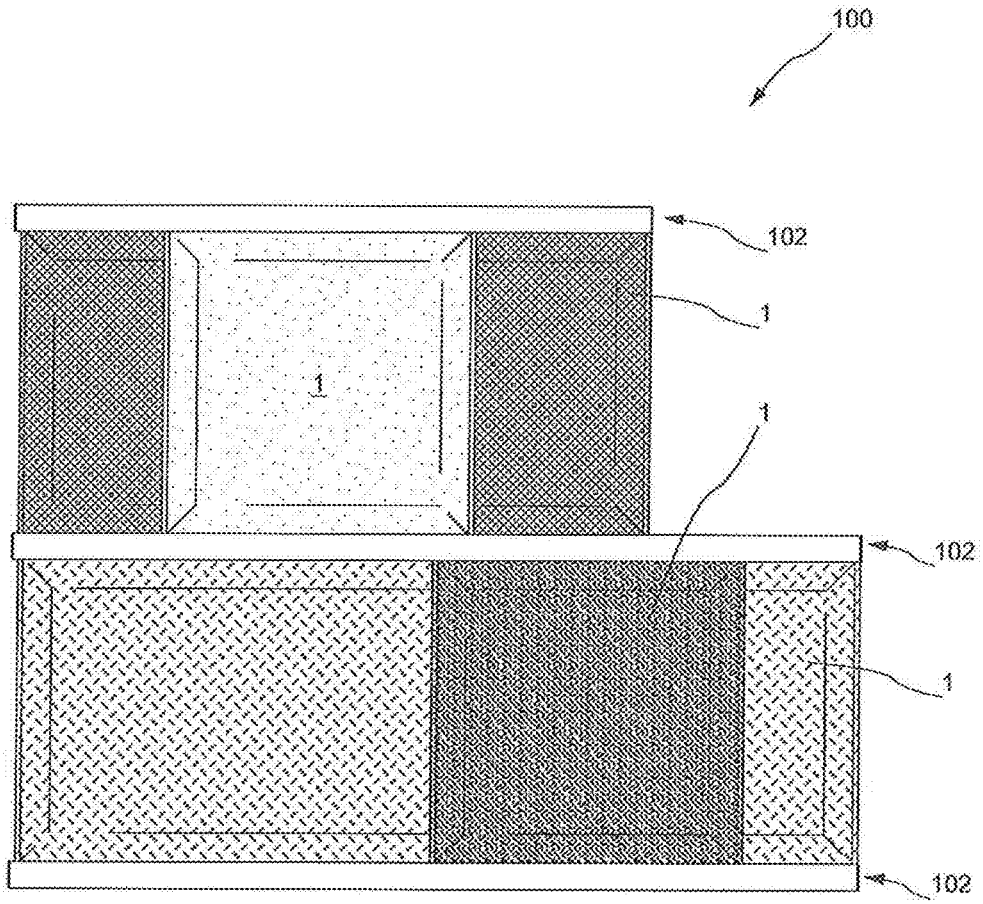
FIG. 9 is a front view of a composition of panels obtained with the system according to the invention.

FIG. 9 shows, purely by way of example, a combination of panels obtained with the system according to the invention. The system comprises three guides, one of which is shorter than the other two. In the upper row a light coloured square panel is visible, said panel being displaceable inside external guide grooves and covering partially a darker panel. Similarly, a darker panel in the lower row also partially covers a lighter coloured panel. The square panels situated outermost (when viewing the figure) may be displaced as required inside the guide grooves.

In some embodiments, the width of the guides 102 may be such that the guides may be used as shelves for books or other objects. In this case, the guide grooves could be in the front part, so as to leave a useful space towards the wall of, for example, about 15-25 cm or be positioned towards the wall so as to leave about 25-35 cm from the side opposite the wall for supporting objects and/or books.

In other embodiments, the guides could house lights, for example of the LED type or the like, for providing illumination and lighting effects.

The invention claimed is:

1. A system for arranging a plurality of sound-absorbing, sound-reflecting panels or the like, the system comprising a first and a second guide and a first and a second panel;

wherein each of said guides comprises a longitudinal axis (L), a first longitudinal groove and a second longitudinal groove substantially parallel to said longitudinal axis (L), and at least one fixing member;

wherein the first panel is retained inside the first groove of the first and second guides and the second panel is retained inside the second groove of the first and second guides;

wherein at least one of the panels is displaceable in a guided manner inside the respective longitudinal groove; and wherein said fixing member comprises a wall mount with a pin and a screw configured to engage inside a threaded hole of said pin and a hole in the guide.

2. The system as claimed in claim 1, wherein at least one of said guides also comprises a third longitudinal groove and a fourth longitudinal groove.

3. The system as claimed in claim 1, wherein at least one of said guides is at least partially made of wood.

4. The system as claimed in claim 1, wherein at least one of said guides is at least partially made of a plastic or thermoplastic material.

5. The system as claimed in claim 1, wherein at least one of said guides is at least partially made of a metallic material.

6. The system as claimed in claim 5, wherein said metallic material is chosen from the group comprising steel, stainless steel, aluminium and aluminium alloy.

7. The system as claimed in claim 1, wherein said wall mount also further comprises a plate with holes for fixing the plate to a wall by means of screws or some other known system.

8. The system as claimed in claim 1, wherein the threaded through-hole has an axis substantially perpendicular to the longitudinal axis (P) of the pin.

9. The system as claimed in claim 1, wherein at least one guide comprises a first hole for receiving the pin and a second hole for receiving the screw which engages inside the threaded through-hole, wherein the first and second holes have axes which are perpendicular to each other, wherein the first axis is substantially horizontal and the second axis is substantially vertical, in the direction of the depth of the grooves.

10. The system as claimed in claim 9, wherein the first hole has a diameter substantially greater than the diameter of the pin.

11. The system as claimed in claim 1, also comprising, for at least one of the guides, at least one closing element.

12. The system as claimed in claim 1, wherein said system is fixed to one or more vertical uprights positioned on a wall, at a certain distance from a wall or substantially in the centre of a room.

* * * * *